United States Patent [19]

Lonardo

[11] 4,337,789

[45] Jul. 6, 1982

[54] SHUT-OFF VALVE FOR INTERRUPTING A FLOW OF A FLUID THROUGH A PIPELINE

[75] Inventor: Pietro Lonardo, Genoa, Italy

[73] Assignee: Hermann Rappold & Co. GmbH, Düren, Fed. Rep. of Germany

[21] Appl. No.: 137,752

[22] Filed: Apr. 7, 1980

[30] Foreign Application Priority Data

Apr. 9, 1979 [IT] Italy ..... 12541 A/79

[51] Int. Cl.[3] ..... F16K 3/00; F16K 49/00

[52] U.S. Cl. ..... 137/340; 137/334; 251/174; 251/327

[58] Field of Search ..... 137/340, 375, 334; 251/174, 196, 327, 330

[56] References Cited

U.S. PATENT DOCUMENTS

| | | | |
|---|---|---|---|
| 1,219,501 | 3/1917 | Stevens | 137/340 |
| 1,995,727 | 3/1935 | Wetherbee | 137/340 |
| 3,273,855 | 9/1966 | Wells | 251/174 |
| 3,552,423 | 1/1971 | Vietorisz | 137/340 |
| 3,941,186 | 3/1976 | Schneider | 137/340 |
| 4,195,655 | 4/1980 | Augsburger et al. | 137/340 |

FOREIGN PATENT DOCUMENTS

| | | | |
|---|---|---|---|
| 1226609 | 2/1960 | France | 137/340 |

*Primary Examiner*—A. Michael Chambers
*Attorney, Agent, or Firm*—Wenderoth, Lind & Ponack

[57] ABSTRACT

A shut-off valve for interrupting a flow of a fluid through a pipeline, particularly a flow of high temperature air in a gas main associated with a blast furnace, includes a valve body adapted to be connected to the pipes of the pipeline. The valve body has a pair of spaced walls having openings aligned with each other and with the pipes when the valve body is connected to the pipes. The valve body has therein a chamber. A valve plate is movably mounted within the valve body for movement between a closed position, whereat the valve plate extends between and interrupts communication between the openings, and an opened position, whereat the valve plate is positioned within the chamber and opens communication between said openings. A gaseous cooling fluid is introduced into the chamber. The valve plate has therein channels through which the gaseous cooling fluid passes when the valve plate is in the closed position, to thereby cool the valve plate. The arrangement is such that the gaseous cooling fluid, after being heated during cooling of the internal portions of the valve, is allowed to be returned to the gas within the gas main, thereby avoiding heat losses.

7 Claims, 9 Drawing Figures

SHUT-OFF VALVE FOR INTERRUPTING A FLOW OF A FLUID THROUGH A PIPELINE

BACKGROUND OF THE INVENTION

The present invention is directed to a shut-off valve for interrupting a flow of a fluid through a pipeline. The present invention is particularly directed to such a valve for interrupting a flow of high temperature air in a gas main associated with a blast furnace, such high temperature air coming from heaters commonly referred to as "cowpers" destined for a blast furnace and eventually to be discharged into the atmosphere.

Modern systems employed to operate blast furnaces and the high temperatures and pressures involved therein cause the size of the mains to be very large and cause the temperature of the air supplied to the blast furnaces to be very high. This causes dangerous working conditions, particularly involved with operation of interception devices, such as shut-off valves, which permit carrying out of the necessary heating cycles and thermal exchange of the cowpers to take place.

Presently known interception devices, of the shut-off valve type and known as "hot air gate valves," are water cooled. Such water cooled shut-off valves however suffer from certain inherent disadvantages. Specifically, the temperature of the cooling water must be kept very low, with the result that there are sudden, cyclical, thermal changes within the structure of the shut-off valve. Additionally, the use of water as a cooling fluid results in massive losses of considerable quantities of heat.

SUMMARY OF THE INVENTION

With the above discussion in mind, it is a primary object of the present invention to provide an improved shut-off valve of the type described above which eliminates, if not all, then most of the disadvantages of prior art shut-off valves.

It is a further object of the present invention to provide such an improved shut-off valve which employs a gaseous cooling fluid, such as air. The use of a gaseous cooling fluid makes it possible to reduce the difference between the hot air passing through the main and to be intercepted by the shut-off valve and the cooling fluid, thus resulting in only minor changes in the thermal cycle of the structure.

It is a further object of the present invention to provide such an improved shut-off valve whereby the gaseous cooling fluid, after achieving the intended cooling function, is discharged into the hot air main itself, thereby returning the heat to the hot air in the main and avoiding the loss of massive quantities of heat.

The above objects are achieved in accordance with the present invention by the provision of a shut-off valve including a valve body adapted to be connected to the pipes of a pipeline, the valve body having a pair of spaced walls having openings aligned with each other and with the pipes when the valve body is connected thereto, the valve body having therein a chamber. A valve plate is movably mounted within the valve body for movement between a closed position, whereat the valve plate extends between and interrupts communication between the openings, and an opened position, whereat the valve plate is positioned within the chamber and opens communication between the openings. A gaseous cooling fluid, for example, air, is introduced into the chamber. Passage means extend through the valve plate for receiving the cooling fluid and for thereby cooling the valve plate when the valve plate is in the closed position thereof.

In accordance with one embodiment of the present invention, the openings in the spaced walls of the valve body are rectangular, for example, square, each rectangular opening being defined by a first end edge remote from the chamber, a second end edge adjacent the chamber and a pair of spaced lateral edges extending between the first and second end edges. An end movable member is positioned between the spaced walls adjacent the first end edges of the openings, and a pair of lateral movable members are positioned between the spaced walls adjacent respective of the lateral edges of the openings. The movable members are mounted within the valve body for movement between respective inner positions, whereat inner edges of the movable members define respective edges of a passage through the valve body between the openings, and outer positions. The valve plate has on an end thereof remote from the chamber a portion positioned between the spaced walls and having an inner edge adjacent the second end edges of the openings, and the inner edge defining a respective edge of the passage through the valve body when the valve plate is in the opened positioned thereof. The portion of the valve plate and the movable members have cooperating structure for enabling movement of the valve plate from the opened position thereof to the closed position thereof to cause movement of the movable members from the inner positions thereof to the outer positions thereof.

The valve body includes inner recesses to receive respective of the movable members in the outer positions thereof. Means are provided for urging the movable members to the inner positions thereof, and such means may be springs or similar elements. The cooperating structure may comprise complimentary and mutually engageable beveled edge surfaces on opposite ends of the portion of the valve plate and the movable members.

The valve plate may include a pair of flanges, each flange extending outwardly from a respective major surface of the valve plate. Each flange is dimensioned to substantially enclose a respective opening in a respective wall of the valve body when the valve plate is in the closed position thereof. Each of a pair of seal devices is positioned within the valve body adjacent a respective opening. Means, e.g. elastic members, urge each seal device toward a respective flange when the valve plate is in the closed position thereof, and toward respective sides of the movable members and the portion of the valve plate when the valve plate is in the opened position thereof. Each seal device may comprise an integral rectangular-shaped seal, or alternatively, four separate seals arranged in a rectangular configuration. Each sale device, and the respective elastic member, is such that the seal device allows the limited passage of the cooling fluid from the interior of the valve body between the seal device and the respective flange, or between the seal device and the respective sides of the movable members and the portion of the valve body, to enable the gaseous cooling fluid, after cooling the valve plate and the interior of the valve body, to be returned to the hot air in the gas main. Each of the flanges is preferably rectangular-shaped.

The valve plate has at the end thereof most remote from the openings a peripheral flange, and the valve body has therein a peripheral seat positioned to be contacted by the peripheral flange when the valve plate is in the closed position thereof, to thereby form a seal isolating the chamber from the openings. The passages through the valve plate comprise channels which have first ends opening into the chamber outwardly of the peripheral flange and second opposite ends opening freely outwardly of at least one of the flanges at positions remote from the chamber.

The valve plate is made of two or more plate layers defining therebetween the channels and being covered with refractory or insulating material. The channels are configured to allow for a regulated flow of gaseous cooling fluid through the valve plate.

In accordance with a further embodiment of the present invention, which is somewhat more efficient and less expensive than the above described embodiment, the valve body has therein a further chamber at a position opposite the chamber with respect to the openings. There is provided a further plate having therethrough an aperture, the further plate being connected to and being movable with the valve plate such that when the valve plate is in the closed position thereof, the further plate is housed within the further chamber, and such that when the valve plate is in the opened position thereof the aperture of the further plate is aligned with the openings in the spaced walls of the valve body. The valve plate and the further plate are guided during movement thereof by means of guide rails which are preferably U-shaped members positioned within the valve body and receiving and guiding lateral borders of the valve plate and the further plate. Preferably the openings in the space walls of the valve body and the aperture in the further plate are circular.

The valve plate may include a pair of flanges, each flange extending outwardly from a respective major surface of the valve plate. Each such flange is dimensioned to substantially enclose a respective opening in a respective wall of the valve body when the valve plate is in the closed position thereof. Each of a pair of seal devices is positioned within the valve body adjacent a respective opening and is urged, for example by means of elastic members, toward a respective flange when the valve plate is in the closed position thereof and toward a respective side of the further plate, at locations surrounding the aperture therein, when the valve plate is in the opened position thereof. The flanges are preferably circular-shaped, and the seal devices preferably each comprise an integral circular-shaped seal.

Each seal device and the respective elastic member is such that there is allowed the limited passage between the seal device and the flange, or alternatively between the seal device and the respective side of the further plate, of a regulated amount of cooling fluid, after the cooling fluid has cooled the valve plate and/or the interior of the valve body, from the interior of the valve body to the hot air within the gas main.

Preferably, the valve plate has at the end thereof remote from the further plate outer flanges, and the valve body has therein seats positioned to be contacted by the outer flanges when the valve plate is in the closed position thereof, thereby forming a seal tending to isolate the chamber from the openings. The passages in the valve plate comprise channels having first ends opening into the chamber outwardly of the outer flanges and second ends opening freely outwardly of the flanges at positions remote from the chamber.

The valve plate is preferably made of two or more plate layers joined to define therebetween the channels for the passage through the valve plate of the gaseous cooling fluid. The external surfaces of the plate layers are covered by suitable refractory or insulating materials. The aperture through the further plate is of the same size as the openings in the opposite walls of the valve body, thereby forming an internal passage through the valve body when the valve plate is in the opened position thereof.

BRIEF DESCRIPTION OF THE DRAWINGS

Other objects, features and advantages of the present invention will be apparent from the following detailed description of preferred embodiments thereof, with reference to the attached drawings, wherein.

DETAILED DESCRIPTION OF THE INVENTION

Figure 1:
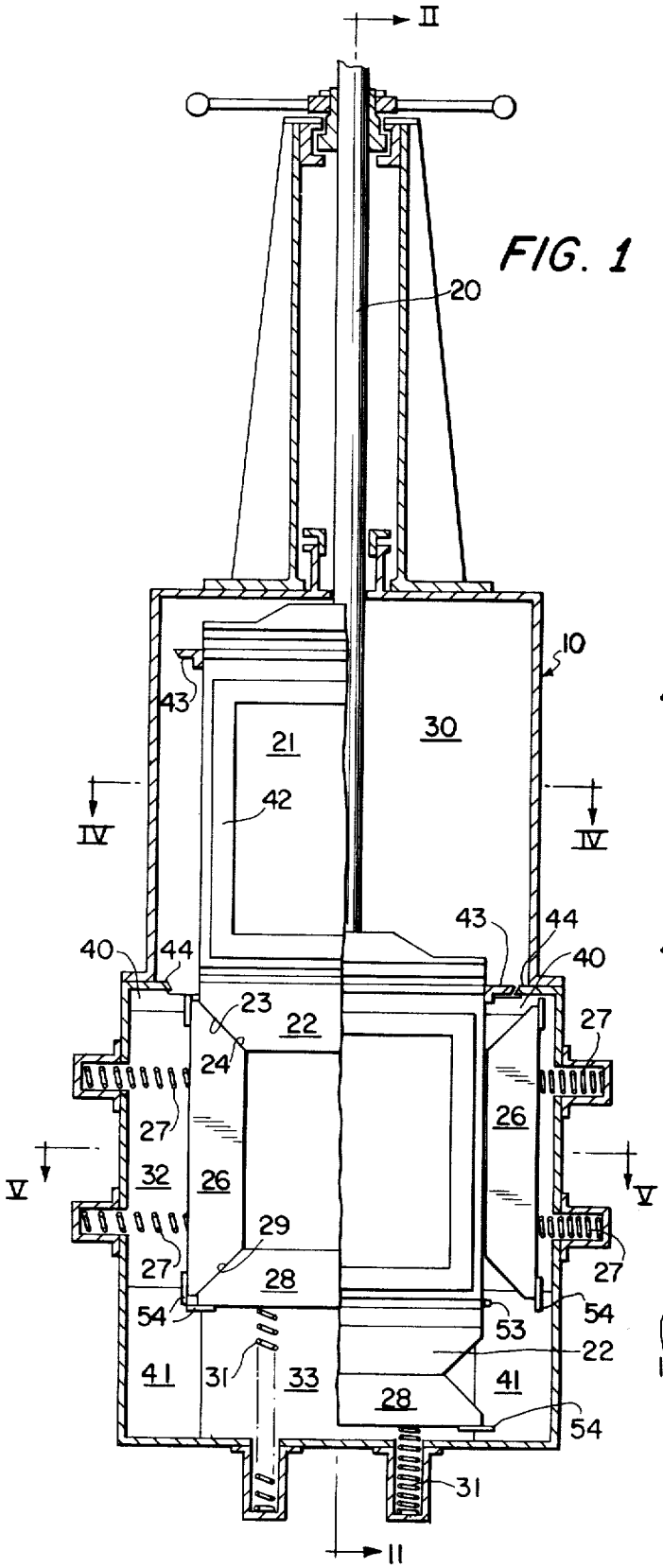
FIG. 1 is a vertical section through a first embodiment of the shut-off valve of the present invention, wherein the left half of FIG. 1 illustrates the open position of the valve, and the right half of FIG. 1 illustrates the closed position of the valve.

In the following discussion, the terms "upper," "lower," "vertical," "horizontal," etc. will be made with reference to the appearance of the valves of the present invention in the accompanying drawings, wherein the movement of the respective valve plates is in vertically upward and downward directions. However, it is to be understood that these terms are descriptive of the drawings and are exemplary only and do not limit the scope of the present invention, inasmuch as the improved valve of the present invention may obviously be oriented otherwise than as shown in the attached drawings.

With reference to FIGS. 1 through 5 of the drawings, a first embodiment of the present invention will be described. The shut-off valve of this embodiment of the invention includes a generally flattened valve body 10 having in opposite spaced walls thereof respective openings 11 and 12, the edges of which are equipped with flanges 15 and 16, respectively, for connection to pipes of a pipeline, for example, a high temperature air main, not shown in the drawings. Such manner of connection of the valve of the present invention to the high temperature air main may be achieved in any conventional and known manner. The valve body 10 has therein an upper chamber 30. A hole extends through the top of the valve body 10 for receipt therethrough in a conventional manner of a driving shaft or rod 20 which is connected to a valve plate 21 to achieve opening and closing movement of the valve plate. The manner of operation of driving shaft or rod 20 may be any conventionally known arrangement. The valve plate 21 is movable by the driving shaft or rod 20 within the valve body 10 between a closed position, shown in the right hand portions of FIGS. 1, 2, 4 and 5, whereat the valve plate 21 extends between and interrupts communication between openings 11 and 12, and an opened position, shown in the left hand portions of FIGS. 1, 2, 4 and 5, whereat the valve plate 21 is positioned within chamber 30 and opens communication between openings 11 and 12.

Figure 2:
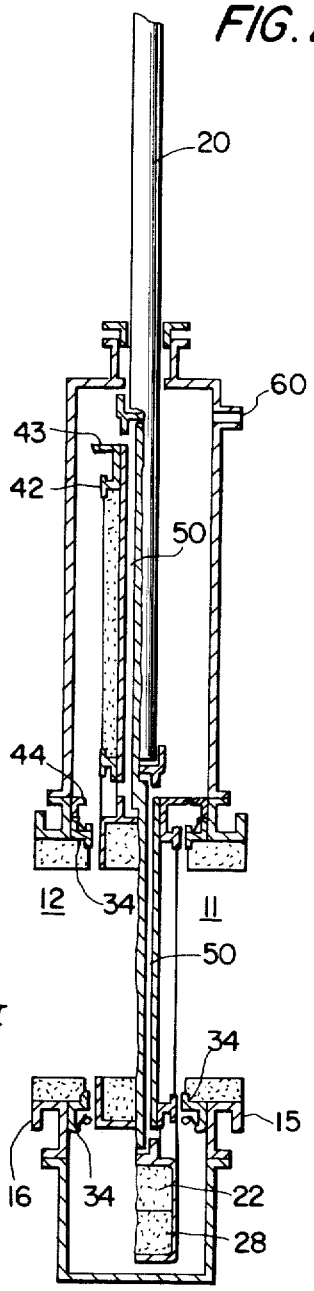
FIG. 2 is a cross-sectional view taken along line II—II of FIG. 1, the left half of FIG. 2 illustrating the open position of the valve and the right hand portion of FIG. 2 illustrating the closed position of the valve.

Means, shown schematically at 60 in FIG. 2 is provided for introducing a gaseous cooling fluid into chamber 30. Passages 50 extend through valve plate 21 for receiving the gaseous cooling fluid from chamber 30.

The openings 11 and 12 are rectangular, and each such rectangular opening is defined by a lower end edge, an upper end edge and a pair of spaced lateral edges extending between the lower and upper end edges. There is provided an end movable member 28 positioned between the spaced walls adjacent the lower end edges of openings 11 and 12. There are also provided a pair of lateral movable members 26 positioned between the spaced walls adjacent respective of the lateral edges of the openings 11 and 12. The movable members 26 and 28 are mounted within the valve body 10 for movement between inner positions, shown in the left hand portions of FIGS. 1, 2, 4 and 5, whereat the inner edges of the movable members define respective edges of a passage through the valve body 10 between the openings 11 and 12, and outer positions, shown in the right hand portions of FIGS. 1, 2, 4, and 5. The valve plate 21 has on a lower end thereof a portion 22 positioned between the spaced walls of the valve body. When the valve plate is in the opened position thereof, the portion 22 is adjacent the upper end edges of the openings 11 and 12, and the portion 22 has an inner edge defining a respective edge of the passage through the valve body 10 when the valve plate 21 is in the opened position thereof. This relationship is shown in the left hand portions of FIGS. 1, 2, 4 and 5.

The opposite ends of the portion 22 are beveled as at 23. The upper ends of the lateral movable members 26 are beveled as at 24. When the valve plate 21 is in the opened position thereof, then as shown in the left hand portion of FIG. 1, the beveled edges 23 and 24 are complimentary and in mutual engagement. Also, the opposite ends of the lower movable member 28 are beveled as shown at 29. The lower ends of lateral movable members 26 are similarly beveled, such that when the valve plate 21 is in the opened position thereof, the beveled edges of the lower ends of lateral movable members 26 are complimentary to and in mutual engagement with the beveled edges 29 of lower movable member 28. This relationship is shown in the left hand portion of FIG. 1.

The valve body 10 is provided with lateral recesses 32 to receive the lateral movable members 26. Similarly, the valve body 10 is provided with a lower recess 33 to receive the lower movable member 28. Means are provided for urging the movable members 26 and 28 to the inner positions thereof. In the illustrated embodiment, such urging means comprise coil springs 27 and 31. However, it is to be understood that other similarly operable means could be provided. It is further to be understood that the movable members 26 and 28 could be positively moved from the inner to the outer positions thereof, or alternatively, from the outer to the inner positions thereof by any known types of arrangements, for example, solenoids, etc.

Accordingly, when the valve plate 21 is in the upper, opened position thereof, then the arrangement will be as shown in the left hand portion of FIG. 1. Lateral springs 27 urge lateral movable members 26 inwardly until beveled edges 24 abut with beveled edges 23 of portion 22 of valve plate 21. Lower springs 31 urge lower movable member 28 upwardly until beveled edges 29 abut with the beveled edges on the lower ends of lateral movable members 26. The inward movement of movable members 26 and 28 may be further restricted by suitable means such as pins 53. Thus, tabs 54 provided on the movable members 26 and 28 may be positioned to abut with pins 53 which are attached to the valve body, thereby limiting inward movement of movable members 26 and 28.

As the valve plate 21 is lowered toward its closed position, beveled edges 23 of portion 22 will slide along beveled edges 24 of lateral movable members 26, thereby causing movable members 26 to move laterally outwardly. Simultaneously, the beveled edges at the lower ends of movable members 26 will slide on beveled edges 29 of lower movable member 28. Eventually, the lateral sides of valve plate 21 will slide along the inner, vertical edges of movable members 26. Thereafter, the valve plate 21 will be lowered to a position such that the bottom edge of portion 22 contacts the upper edge of lower movable member 28. Further movement of the valve plate 21 will cause downward movement of movable member 28 against the force of springs 31 until the valve plate is in the wholly closed position thereof, as shown in the right hand portion of FIG. 1. It will be apparent that movement of the valve plate 21 from the closed position thereof shown in the right hand portion of FIG. 1 to the opened position thereof shown in the left hand portion of FIG. 1 will involve a reversal of the above described movements of lower movable member 28 and lateral movable members 26.

The interior of valve body 10 is provided with means for guiding the above described movements of movable members 26 and 28. Such means may be in the form of the illustrated facing pairs of plates 40 and 41 shown in FIG. 1 of the drawings. Thus, plates 40 and the upper portions of plates 41 guide the upper and lower ends of lateral movable members 26 during movement thereof. Plates 41 guide the opposite ends of lower movable member 28 during the movement thereof.

Furthermore, the valve of the present invention provides means for guiding the movement of the valve plate 21 during opening and closing movements thereof.

Figure 3:
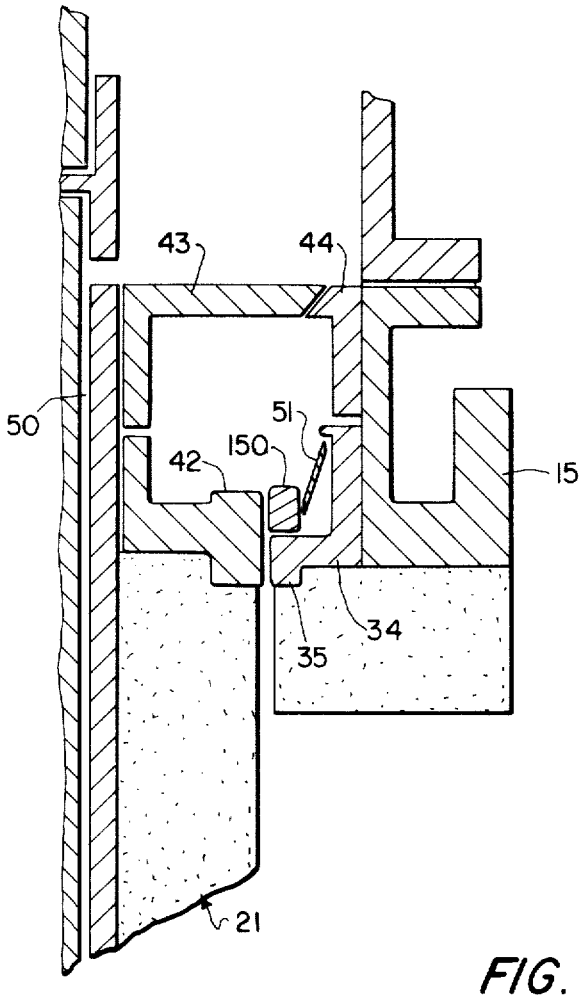
FIG. 3 is an enlarged sectional view of a portion of FIG. 2.
Figure 5:
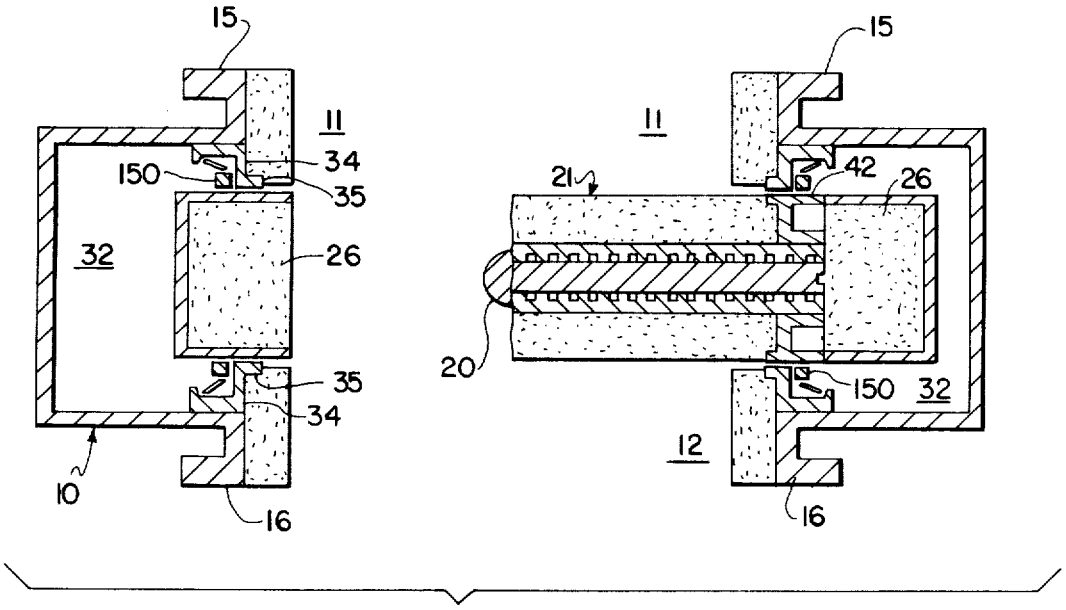

Specifically, as shown in FIGS. 2, 3 and 5, the valve body 10 has adjacent each of openings 11 and 12 a frame 34 which faces inwardly of valve body 10. The transverse section of frame 34 is substantially Z-shaped and provides a wing 35 which faces interiorly of the valve body 10. The inner surface of each wing 35 is provided in a plane which is parallel to the adjacent side of the valve plate 21. In the illustrated arrangement, each major surface of valve plate 21 has extending outwardly therefrom a flange 42 which, during movement of the valve plate 21, lightly runs against the surface of the respective wing 35 of the respective frame 34. The flanges 42 and the frames 34 are preferably rectangular-shaped.

There are further provided a pair of seal devices 150, shown particularly in FIG. 3. Each seal device 150 is positioned within the valve body 10 adjacent a respective opening 11 or 12. Means, for example, elastic members 51, are provided for urging each seal device 150 toward a respective flange 42 when the valve plate 21 is in the closed position thereof and toward respective sides of the movable members 26, 28 and portion 22 of valve plate 21 when the valve plate is in the open position thereof. The left hand portion of FIG. 5 shows the pair of seal devices 150 being urged toward respective sides of one movable member 26, and the right hand portion of FIG. 5 shows the seal devices 150 being urged toward the respective flanges 42 of the valve plate 21. As shown particularly in FIG. 3, the facing edge of flange 42 is larger than the adjacent facing edge of wing 35 of frame 34, to allow for seal device 150 to be accommodated. Each seal device 150 may be an integral, rectangular-shaped seal, or alternatively may be formed of four separate seals arranged in a rectangular configuration.

As shown particularly in FIGS. 1 and 2, the valve plate 21 has at the upper end thereof a peripheral flange 43, and the valve body 10 has therein a peripheral seat 44 positioned to be contacted by the peripheral flange 43 when the valve plate 21 is in the closed position thereof, to thereby form a seal isolating chamber 30 from openings 11 and 12. In the illustrated arrangement, the contacting surfaces of flange 43 and seat 44 are mutually beveled, but other contacting surface configurations could be employed.

Figure 4:
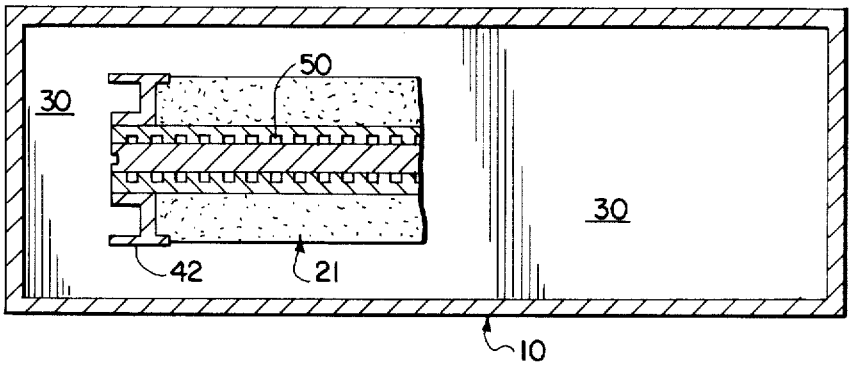
FIGS. 4 and 5 are cross-sectional views taken along lines IV—IV and V—V, respectively, of FIG. 1, the left hand portions of each of FIGS. 4 and 5 illustrating the open position of the valve and the right hand portions of FIGS. 4 and 5 each illustrating the closed position of the valve.

As shown particularly in FIG. 4, the valve plate 21 includes an inner core formed of at least two plate members, for example, metal plate members. In the arrangement illustrated in FIG. 4, there are three metal plates positioned together to provide therebetween the flow channels 50. It will be understood that only two plate members or more than three plate members may be provided. The outer surfaces of the outer plate members are covered with refractory material. As shown particularly in FIGS. 1 and 2, the channels 50 have upper ends which open into the chamber 30 at positions above the peripheral flange 43. The channels 50 have lower ends which open freely at a level below the lower run of one of the flanges 42.

With reference to the left hand portions of FIGS. 1 and 2, the cooling system of this embodiment of the present invention when the valve plate 21 is in the opened position thereof will be described. Specifically, the gaseous cooling fluid is introduced into chamber 30 through suitable means, for example, supply pipe 60 from a source of gaseous cooling fluid, not shown. The gaseous cooling fluid within chamber 30 will pass through the internal border of seat 44 and the lateral border of lower portion 22 of valve plate 21 into the lateral recesses 32. From lateral recesses 32 the gaseous cooling fluid will pass to lower recess 33. The cooling fluid will thereby cool the valve body 10, the valve plate 21 and the movable members 26 and 28. This gaseous cooling fluid will then escape from the interior of the valve body into the flow of high temperature gas passing through the gas main. This will be achieved by the gaseous cooling fluid passing into the gas main through an inevitable clearance or space between the seal devices 150 and the adjacent side surfaces of the movable members 26 and 28 and of portion 22 of the valve plate. Thus, when the valve is in the open position thereof, the gaseous cooling fluid, for example air, which has become somewhat heated by removing heat from the various elements of the valve, enters into the flow of high temperature gas passing through the gas main, thereby returning the acquired heat to the high temperature gas and avoiding heat losses which were inevitable in prior art, liquid cooled devices.

With reference now to the right hand portions of FIGS. 1 and 2, the cooling system of the present invention when the valve plate 21 is in the closed position thereof will be described. With the valve plate 21 in the closed position, peripheral flange 43 contacts peripheral seat 44, thereby isolating chamber 30 from openings 11 and 12 and preventing the gaseous cooling fluid from directly passing into recesses 32. Rather, the gaseous cooling fluid enters the upper open ends of channels 50, passes through channels 50 thereby cooling the valve plate 21, and exits through the open lower ends of channels 50 into the recess 33. From recess 33, the gaseous cooling fluid enters lateral recesses 32. Thus, even when the valve plate 21 is in the closed position thereof, the gaseous cooling fluid will still cool all of the various elements of the valve. From the recesses 32 and 33, the gaseous cooling fluid which has been heated by removing heat from the elements of the valve passes through clearances between the seal devices 150 and the flanges 42 of the valve plate and passes into the high temperature gas within the main. Specifically, when the valve plate 21 is in the closed position thereof, there will be a strong pressure in the up-stream portion of the main. For example, if the up-stream portion of the main is represented by opening 11, then the high pressure of the high temperature gas in such up-stream portion will tend to press the valve plate 21 strongly against the seal device 150 and wing 35 adjacent the downstream opening 12. Thus, the heated cooling fluid will substantially exit into the up-stream portion of the main.

It of course is to be understood that the seal devices 150 and the elastic members 51 may be designed to achieve the desired degree of sealing and to allow the desired degree of regulated passage of heating cooling fluid therethrough. This will depend upon the requirements and operating parameters of a given installation. The object to be achieved in accordance with the present invention is however that the gaseous cooling fluid, after achieving a satisfactory cooling of the interior parts of the valve, be resupplied into the gas main, to thereby avoid the loss of heat.

As shown in the drawings, the movable members 26 and 28 as well as lower portion 22 of the valve plate are formed of U-shaped metal members, the recesses of which face interiorly, such recesses being filled by a refractory or insulating material.

In this illustrated embodiment of the invention, the position of movable members 26 and 28 is determined by the position of valve plate 21 and by the elastic action of springs 27 and 31. It is to be understood however that other mechanical, pneumatic, hydraulic or similar positioning systems may be used in place of springs 27 and 31. Furthermore, an additional similar such system may be used to position valve plate 21 in place of rod 20.

Figure 6:
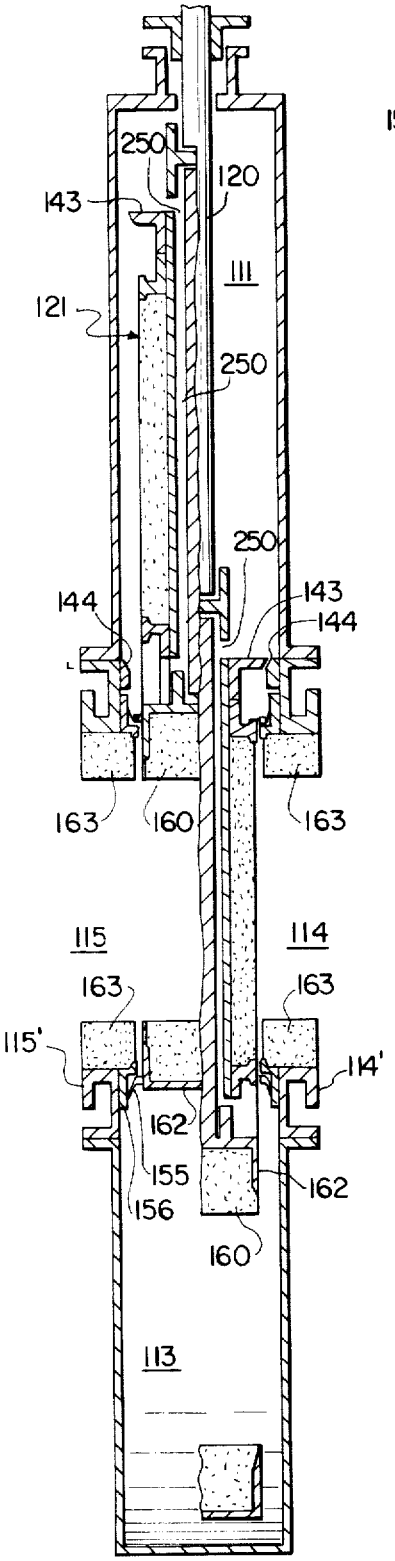
FIG. 6 is a view similar to FIG. 2, but of a second embodiment of the present invention, the left hand portion of FIG. 6 showing the open position of the valve and the right hand portion of the FIG. 6 illustrating the closed position of the valve.
Figure 7:
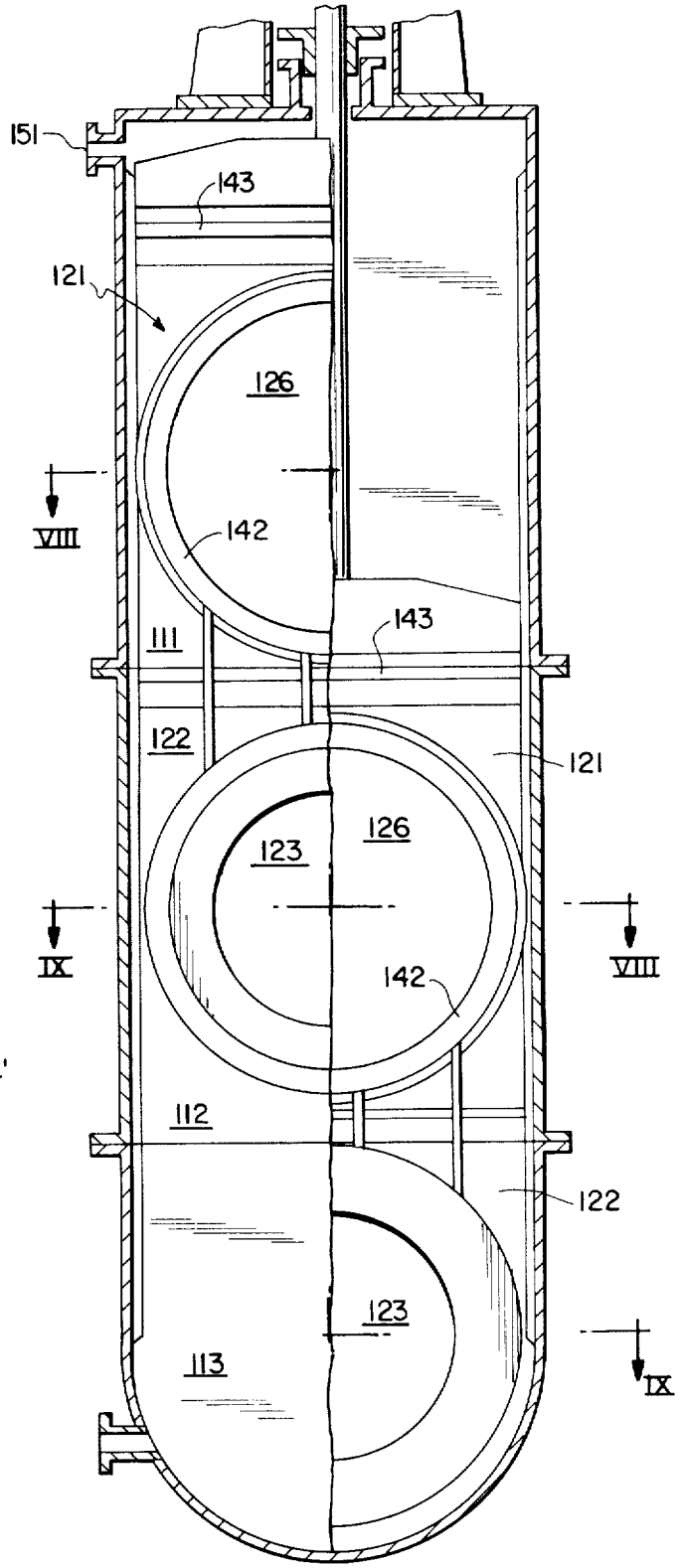
FIG. 7 is a view similar to FIG. 1, but of the embodiment shown in FIG. 6, the left hand portion of FIG. 7 showing the open position of the valve and the right hand portion of FIG. 7 illustrating the closed position of the valve.
Figure 8:
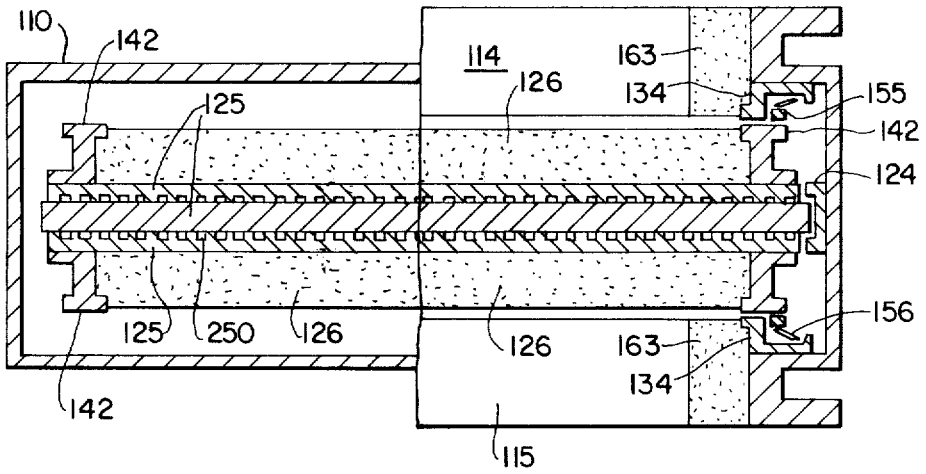
FIG. 8 is a cross-sectional view taken along broken line VIII—VIII of FIG. 7, the left hand portion of FIG. 8 illustrating the closed position of the valve and the right hand portion of FIG. 8 illustrating the open position of the valve.

With reference now to FIGS. 6 through 8 of the drawings, a second embodiment of the present invention will be described.

In this embodiment of the present invention, the valve body 110 has therein three sections, i.e., upper chamber 111, a middle section 112, and a lower or further chamber 113. Middle section 112 includes opposite spaced walls having formed therein openings 114 and 115 provided with flanges 114' and 115', respectively, for connection with adjacent pipes of a pipeline, for example, a high temperature gas main.

The valve plate 121 is activated by means of a rod 120, or by means of any other appropriate known arrangement, in a manner similar to that of the previous embodiment. The size of upper chamber 111 is such that it can completely accommodate therein valve plate 121 when the valve is in the opened position thereof.

Figure 9:
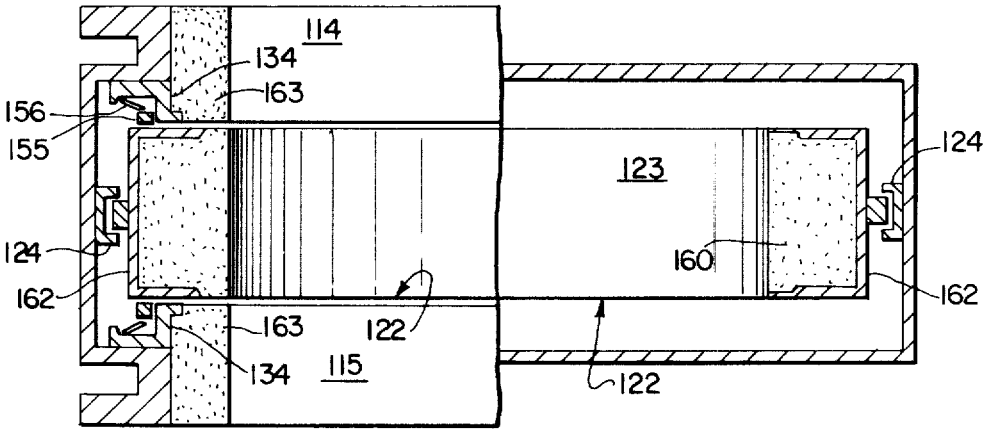
FIG. 9 is a cross-sectional view taken along the broken line IX—IX of FIG. 7, the left hand portion of FIG. 9 illustrating the open position of the valve and the right hand portion of FIG. 9 illustrating the closed position of the valve.

A further plate 122 has extending therethrough an aperture 123. Further plate 122 is connected to and movable with the valve plate 121 such that when the valve plate 121 is in the closed position thereof, the further plate 122 is positioned within the lower chamber 113, and when the valve plate 121 is in the opened position thereof, the aperture 123 of the further plate 122 is aligned with the openings 114 and 115 in the spaced walls of the valve body. The internal diameter of aperture 123 is substantially equal to the diameter of the openings 114 and 115, as particularly shown in the left hand portions of FIGS. 6 and 9. Preferably, openings 114 and 115 and aperture 123 are circular-shaped.

The valve plate 121 and the further plate 122 are guided during movement thereof by means of guide rails, preferably U-shaped members 124 positioned within the valve body 110 and receiving and guiding lateral borders of the valve plate 121 and the further plate 122. This arrangement is particularly shown in the right hand portions of FIG. 8 and in FIG. 9.

As particularly shown in FIG. 8, the valve plate 121 is formed by a core in the form of at least two metal plates 125 which are attached to each other to provide vertical channels 250. In the illustrated arrangement, there are shown three metal plates 125, but only two metal plates or more than three metal plates could be employed. The metal core of the valve plate is covered by refractory material 126.

Extending outwardly from opposite major surfaces of the valve plate 121 are a pair of flanges 142, preferably circular flanges. Positioned within the valve body 110 adjacent a respective opening 114 or 115 is a seal device 155. Means, for example, elastic members 156, urge each seal device 155 toward a respective flange 142 when the valve plate 121 is in the closed position thereof, as particularly shown in the right hand portion of FIG. 8, and toward respective sides of the further plate 122, at locations surrounding the aperture 123 therein, when the valve plate 121 is in the open position thereof, as shown particularly in the left hand portion of FIG. 9. Preferably each seal device 155 is an integral circular-shaped seal.

The top of valve plate 121 has outer flanges 143, and the valve body 110 has therein seats 144 positioned to be contacted by the outer flanges 143 when the valve plate 121 is in the closed position thereof. As particularly shown in FIG. 6 of the drawings, the channels 250 have upper ends which open into the upper chamber 111 at positions above the flanges 143. Further, the channels 250 have lower ends which open freely at positions below the lower portion of one of the flanges 142.

It is believed that the operation of the cooling system of this embodiment will be apparent from the above discussion. Specifically, a gaseous cooling fluid, for example air, is introduced into upper chamber 111 from a suitable source by means of connection 151. When the valve plate 121 is in the opened position thereof, for example as shown in the left portion of FIG. 6, the gaseous cooling fluid will pass from upper chamber 111 into lower chamber 113 via lateral spaces exterior of further plate 122, thereby achieving cooling of the internal elements of the valve. When the gaseous cooling fluid has thereby been heated, the thus heated cooling fluid will pass into the high temperature gas flowing through the gas main by passing between clearances between the respective seal devices 155 and the respective adjacent side surfaces of the further plate 122.

When the valve plate 121 is in the closed position thereof, as particularly shown in the right hand portions of FIGS. 6 and 8, the flanges 143 and seats 144 will prevent the gaseous cooling fluid from passing from the upper chamber 111 downwardly to lower chamber 113. Rather, the gaseous cooling fluid will be constrained to pass from upper chamber 111 into the upper ends of channels 250, and then through channels 250 thereby cooling the valve plate 121. The gaseous cooling fluid will then exit the channels 250 through the lower ends thereof into lower chamber 113. By this arrangement, the entire internal portions of the valve are cooled by the gaseous cooling fluid. The gaseous cooling fluid, thereby heated, is allowed to pass into the high temperature gas in the gas main, normally at the up-stream portion thereof in a manner similar to that described above with respect to the previous embodiment. Namely, such heated gaseous cooling fluid is allowed to pass through clearances between at least the up-stream seal device 155 and the facing adjacent flange 142.

The further plate 122 is of a substantially U-shaped member 162 having an interior facing inwardly, the interior being filled with a refractory material 160. The internal diameter of refractory material 160 equals the interior diameter of refractory materials 163 placed in the openings 114 and 115.

The lateral sides of the U-shaped member 162 perform the same function, when the valve plate 121 is in the opened position thereof, as do flanges 142 when the valve plate is in the closed position thereof.

Although the present invention has been described and illustrated in detail with respect to preferred embodiments thereof, it is to be understood that various changes and modifications may be made to various of the specific structural features described and illustrated without departing from the scope of the present invention.

What is claimed is:

1. A shut-off valve for interrupting a flow of a fluid through a pipeline, particularly a flow of high temperature air in a gas main associated with a blast furnace, said valve comprising:

a valve body adapted to be connected to pipes of a pipeline, said valve body having a pair of spaced walls having openings aligned with each other and with the pipes when said valve body is connected thereto, said openings defining a valved passageway, said valve body having therein first and second chambers on opposite sides of said openings;

a valve plate and a plate connected to said valve plate, said plate having therethrough an aperture, said valve plate and said plate being movably mounted within said valve body for simultaneous movement between a valve closed position, whereat said valve plate extends between and interrupts communication between said openings and said plate is in said second chamber, and a valve open position, whereat said valve plate is in said first chamber and said aperture in said plate is aligned with said openings in said spaced walls of said valve body;

valve seats provided on said valve body at positions adjacent said first chamber and said openings;

outer flanges on said valve plate at an end thereof remote from said plate, said flanges contacting said valve seats and closing communication between said first chamber and said second chamber when said valve plate is in said valve closed position, said flanges being within said first chamber and spaced from said valve seats when said valve plate is in said valve open position, thereby enabling communication between said first and second chambers;

flanges extending outwardly from opposite major surfaces of said valve plate;

a pair of seal devices, each said seal device being positioned within said valve body adjacent a respective said opening;

means for urging each said seal device toward a respective said flange when said valve plate is in said valve closed position and toward a respective side of said plate, at a location surrounding said aperture therein, when said valve plate is in said valve open position;

passage means in said valve plate, said passage means opening at a first end thereof into said first chamber outwardly of said outer flanges and opening at a second opposite end thereof freely outwardly of one of said flanges at a position remote from said first chamber;

cooling means for introducing a gaseous cooling fluid into said first chamber, whereby when said shut-off valve in the closed position said outer flanges contact said valve seats to prevent said cooling fluid from passing between lateral clearances exterior of said valve plate into said second chamber, said cooling fluid passing through said passage means in said valve plate into said second chamber, and whereby when said shut-off valve is in the open position said cooling fluid passes between said outer flanges and said valve seats through said lateral clearances exterior of said apertured plate into said second chamber and then between limited clearances between respective seal devices and sides of said apertured plate into said passageway.

2. A valve as claimed in claim 1, wherein said valve plate and said plate are guided during movement thereof by means of guide rails.

3. A valve as claimed in claim 2, wherein said guide rails are U-shaped members positioned within said valve body and receiving and guiding lateral borders of said valve plate and said plate.

4. A valve as claimed in claim 1, wherein said openings in said spaced walls of said valve body and said aperture in said plate are circular.

5. A valve as claimed in claim 1, wherein each said flange outwardly extending is dimensioned to substantially enclose a respective said wall of said valve body when said valve plate is in said closed position thereof.

6. A valve as claimed in claim 1, wherein said urging means comprises elastic members.

7. A valve as claimed in claim 1, wherein each said seal device comprises an integral circular-shaped seal.

* * * * *